US006543820B2

(12) United States Patent
Kelly

(10) Patent No.: US 6,543,820 B2
(45) Date of Patent: Apr. 8, 2003

(54) LATCHING DEVICE AND METHOD

(75) Inventor: Allan D. Kelly, Asheville, NC (US)

(73) Assignee: GSLE Development Corporation, Charlotte, NC (US)

( * ) Notice: Subject to any disclaimer, the term of this patent is extended or adjusted under 35 U.S.C. 154(b) by 34 days.

(21) Appl. No.: 09/797,182

(22) Filed: Mar. 2, 2001

(65) Prior Publication Data

US 2002/0074807 A1 Jun. 20, 2002

Related U.S. Application Data

(60) Provisional application No. 60/256,547, filed on Dec. 18, 2000.

(51) Int. Cl.[7] ..... E05C 19/10

(52) U.S. Cl. ..... 292/97; 292/DIG. 60; 292/341.18

(58) Field of Search ..... 292/96, 97, 129, 292/221, 223, 229, DIG. 71, DIG. 60, DIG. 38, 341.18, DIG. 56

(56) References Cited

U.S. PATENT DOCUMENTS 2,256,447 A * 9/1941 Burke ..... 292/223
2,507,847 A * 5/1950 Anderson ..... 292/332
2,572,428 A * 10/1951 Anstine ..... 292/341.18
2,669,477 A * 2/1954 Jewell ..... 292/341.18
2,893,772 A * 7/1959 Edwards ..... 292/223
3,045,465 A * 7/1962 Larson ..... 70/153
4,159,137 A * 6/1979 Richter ..... 292/123
4,205,867 A * 6/1980 Loikitz ..... 292/223
4,372,591 A * 2/1983 Cook ..... 292/221
4,415,189 A * 11/1983 Kastelic ..... 292/196
4,502,715 A * 3/1985 Lundblade ..... 292/78
4,880,261 A * 11/1989 Bisbing ..... 292/7
4,969,343 A * 11/1990 Luker ..... 70/92
5,116,089 A * 5/1992 Taylor ..... 292/78
5,127,690 A * 7/1992 Kim ..... 292/340

* cited by examiner

*Primary Examiner*—Gary Estremsky
(74) *Attorney, Agent, or Firm*—Baker & Hostetler LLP

(57) ABSTRACT

The present invention provides a latch device and method for securing a panel such as a door panel to a frame. The latch device has a housing mounted to the door panel with a catch having a contact portion pivotally mounted in the housing for rotation about a first axis while a handle assembly is mounted in the housing for rotation about a second axis. A strike is mounted on the frame such that the strike can receive the catch. The handle assembly is moveable between a first position where the contact portion of the catch is urged into contact against the strike and second position where the catch is retracted from the strike. A link is pivotally mounted to the catch at one point and to the handle assembly at a second point. An adjustment device is provided. The latch device also has a compliance element that absorbs forces resulting from the engagement of the latch assembly.

26 Claims, 8 Drawing Sheets

LATCHING DEVICE AND METHOD

CROSS-REFERENCE TO RELATED APPLICATIONS

This application claims priority of provisional patent application serial No. 60/256,547 entitled Door Latch filed Dec. 18, 2000, in the name of Allan D. Kelly, the disclosure of which is hereby incorporated by reference.

FIELD OF THE INVENTION

The present invention relates generally to latching devices and more particularly to latch assemblies for fastening hinged doors, panels and the like.

BACKGROUND OF THE INVENTION

Various latches are known, including a number of latch assemblies which are operable for securing two panels or a panel against a corresponding frame. In certain applications such as in the case of doors or panels which need to be sealed when closed, such as for example, refrigerator doors, these latching assemblies are advantageously employed. Generally, latches of this type are mounted proximate to the edges of the first panel and on engagement are adapted to compress the first panel against the corresponding second panel or frame and into a secured position. These assemblies are generally actuated by the operator exerting a force on a handle. In such instances, the latch is mounted on the door or panel to be secured, proximate to the periphery. Often a compressible gasket will be provided between the door or panel of the corresponding frame or cabinet, particularly in the context of a refrigerator door.

A disadvantage of some known latching devices is that the latch itself does not provide a positive indication of when the door is fully latched. Another problem with many known latch designs is that the gasket may be made of silicon or PVC which tends to absorb moisture and freeze making the gasket more difficult to compress ("stiffen"). Ice accumulates on the gasket, obstructing the seal and contributing to gasket compression difficulties. As a result of the change in gasket compression, a greater force may be required to operate the latch and compress the first panel against the corresponding second panel or frame and into the secured position which can exceed conventional latch's load limits.

Another problem with many prior art designs is that if the first panel becomes misaligned with the corresponding second panel or frame due to manufacturing defects or normal wear, the latch may be unable to accommodate the misalignment and become inoperable. Due to the misalignment, the panels or frame must be physically aligned, requiring costly maintenance visits.

Thus, there is a need for latching assembly which makes it easy to secure the latch and seal a door to a frame. Similarly, there is a need for latching assembly which seals the door to the frame even when the gasket is obstructed by foreign bodies or the gasket is hardened and difficult to compress. Also, there is a need for an latch assembly that is tolerant of misalignment and may be adjusted horizontally and/or vertically allowing operation even though the panel or door upon which the assembly is mounted is misaligned.

These needs are met by the present invention, as hereinafter described.

SUMMARY OF INVENTION

The present invention provides a latching assembly mountable on a panel for securing the panel to a frame. The latching assembly of the present invention can provide greater mechanical advantage when the latching assembly is closed or open, in comparison with prior art assemblies, permitting refrigerator and freezer doors to be easily and reliably latched and sealed when misalignment occurs or the gasket compression is compromised. The latching assembly of the present invention also can provide enhanced security in comparison with prior art devices, because the assembly in some embodiments provides a key lock and slots where a padlock may be inserted. The key lock and padlock may be used in conjunction with one another or separately to prevent the latch assembly from opening.

In one aspect, the present invention provides a latch device and method for securing a panel to a corresponding second panel or frame. The latch device has a housing mounted to a panel and a catch having a contact portion pivotally mounted in the housing for rotation about a first axis while a handle assembly is mounted in the housing for rotation about a second axis. A strike is mounted on the panel or frame such that the strike can receive the catch. The handle assembly is moveable between a first position where the contact portion of the catch is urged into contact against the strike and second position where the catch is retracted from the strike. The latch device also has a link pivotally mounted to the catch at one point and to the handle assembly at a second point.

In another aspect of the invention, the latch device comprises an adjustment device for modifying a compressive force applied by the latch between a first panel and corresponding second panel.

In another aspect of the invention, the latch device comprises a compliance element that absorbs forces resulting from the engagement of the latch assembly.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

Figure 1:
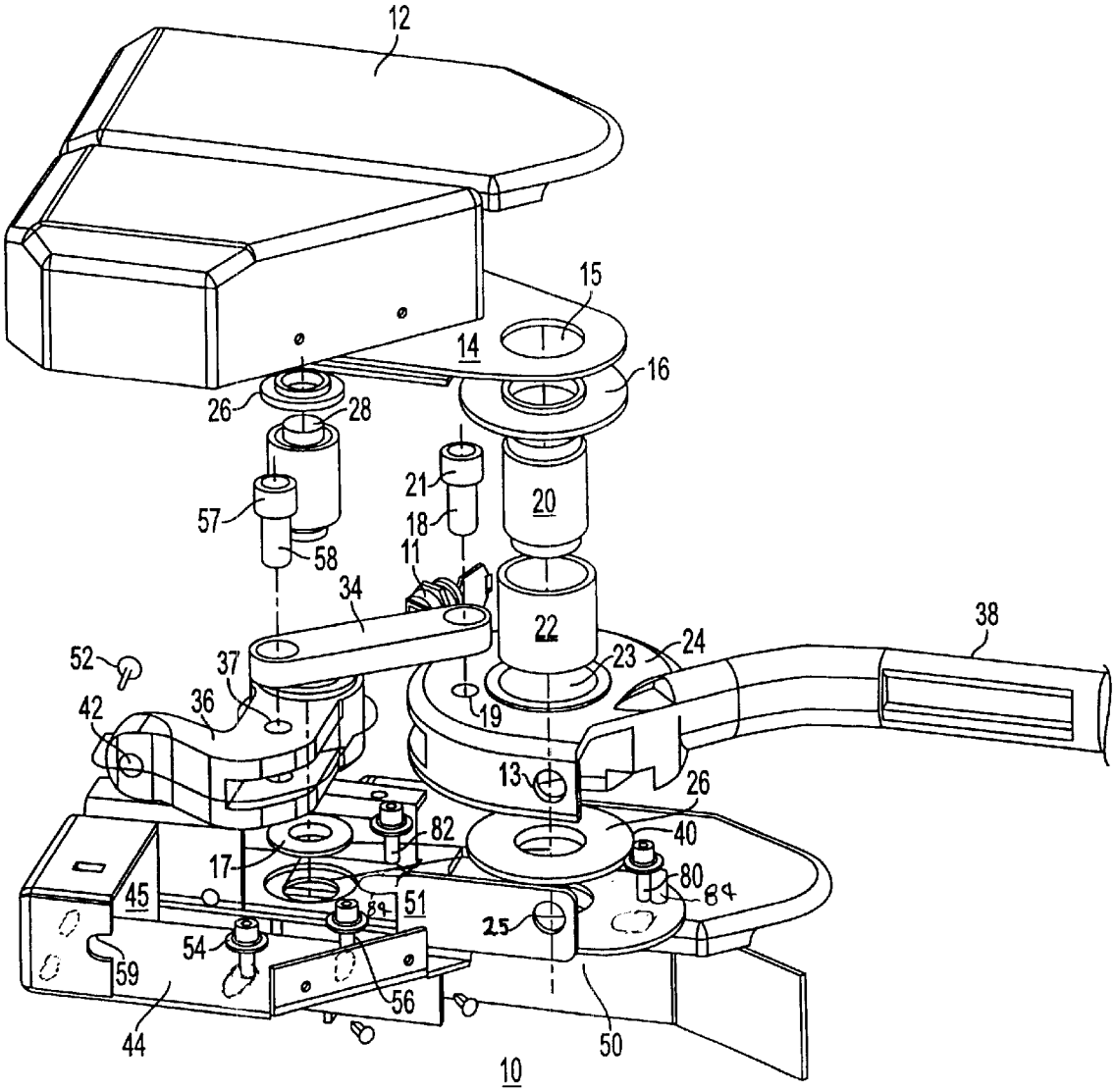
FIG. 1 is an exploded perspective view of the latch assembly.

FIG. 1 illustrates a door latch assembly 10 having a cover plate 12, a catch 36 and a base 50. The cover plate 12 is attached to an outward support 14 via machine screws 60. The pivot pin 20 has a first and second end and the first end is inserted vertically through the structural washer 16 into a circular slot 15 of the outward support 14. The structural washer 16 is spot welded to the outward support 14 to resist contact stress of pivot pin 20. The second end of the pivot pin 20 is inserted through the bushing 22 into the center slot 23 of the driving link 24. The bushing 22 is coupled with the driving link 24 adapting the driving link 24 for receiving and retaining the pivot pin 20 and enabling the driving link 24 to rotate about the pivot pin 20 in a circular motion.

A handle 38 is integral to the driving link 24. The handle 38 and driving link 24 rotate about the pivot pin 20 with a swing angle of 60 degrees. A force may be exerted onto the handle 38 by a user causing the driving link 24 to rotate about the pivot pin 20. The second end of the pivot pin 20 penetrates the center slot 23 of the driving link 24 and inserts through a second structural washer 40 into the base 50.

A key lock 11 is provided adjacent to the driving link 24 for prohibiting the driving link 24 from rotating about pivot pin 20 when the key lock 11 is activated (locked). The key lock 11 may be activated when the latch assembly is engaged, locking the catch 36 in the receptacle 45 of the strike 44. In addition to the key lock 11, engagement of the latch assembly 10 may be locked by insertion of a padlock through the cylindrical slots 13, 25 of the driving link 24 and base 50 respectively. A padlock (not shown) may be used as an alternative to the key lock 11 or in conjunction with the key lock 11.

FIG. 1 further shows an intermediate link 34 having a first end and a second end. The first end is pivotally attached to the driving link 24 via the center link pin 18 which inserts into a cylindrical bore 19 of the driving link 24. The center link pin 18 is coupled with bushings 21 enabling the intermediate link 34 to rotate about the center link pin 18. The second end of the intermediate link 34 is pivotally attached to the catch 36 by a center link pin 58 and bushings 57. The bushings 57 allow the catch 36 rotate about the center link pin 58.

A center pin 28 is inserted through a cylindrical pivot portion of the catch 36 where a first end penetrates the structural washer 26 and engages the outward support 14. A second end of the center pin 28 penetrates the structural washer 17 and engages the base 50, thus attaching the catch 36 to the outward support 14 and base 50.

In one embodiment, the catch 36 extends 2–4 inches horizontally away from the from the center pin 28 and is provided with a vertical end that extends upwardly and allows for one hand operation of the door latch assembly 10. In this embodiment, the catch 36 has an 4 inch extension that allows for convenient engagement of the latch assembly 10 and enables the catch 36 to engage the strike 44 even when the gasket is obstructed by foreign bodies. These dimensions are by way of example only and do not limit other embodiments of the invention, which may be dimensioned differently. The examples of dimensions are provided to illustrate that some embodiments of the invention can provide a greater extension or reach, than some prior art latches.

The catch 36 has a cylindrical screw thread 42 where an adjustment-screw 52 may be inserted. The adjustment screw 52 may be a micro-screw having fine threads. Upon insertion of the adjustment-screw 52, the adjustment-screw may be adjusted to contract or expand the horizontal distance between the strike 44 and the catch 36 so as to increase or decrease the contact force between the catch 36 and strike 44 when the latch is latched, as described in more detail below.

The strike 44 as shown in FIG. 1 has a receptacle end 45 in which the catch 36 may be inserted and has a total of four mounting screws 54 for mounting the strike 44. The strike 44 has a slot 59 which aligns with an adjustment screw housing having a bore 42 when the catch 36 is inserted into the strike 44. The slot 59 permits extension of a tool or hex key into the bore 42. The mounting screws 54, are housed in horizontal slots located on the strike 44. In the embodiment of FIG. 1, the mounting screws 54, provide horizontal positioning ability of the strike 44 with respect to the base 50. Additionally, the mounting screws 80, allow for vertical positioning adjustment of the base 50 relative to the strike 44. The aforementioned positioning adjustment ability of the strike 44 and base 50 allows for reception of the catch 36 when the base 50 and the strike 44 are misaligned due to manufacturing faults of the panels on which the base 50 and strike 44 are mounted or to correct excessive misalignment that may occur during useful life of product.

The intermediate link 34 is operable via exertion of a force upon the handle 38 causing the driving link 24 to rotate about the pivot pin 20. The action of the driving link 24 in turn causes the intermediate link 34 to rotate about the center link pin 18. This rotation of the intermediate link 34 displaces the catch 36 relative to the strike 44 causing the latch assembly 10 to engage or disengage.

Figure 2:
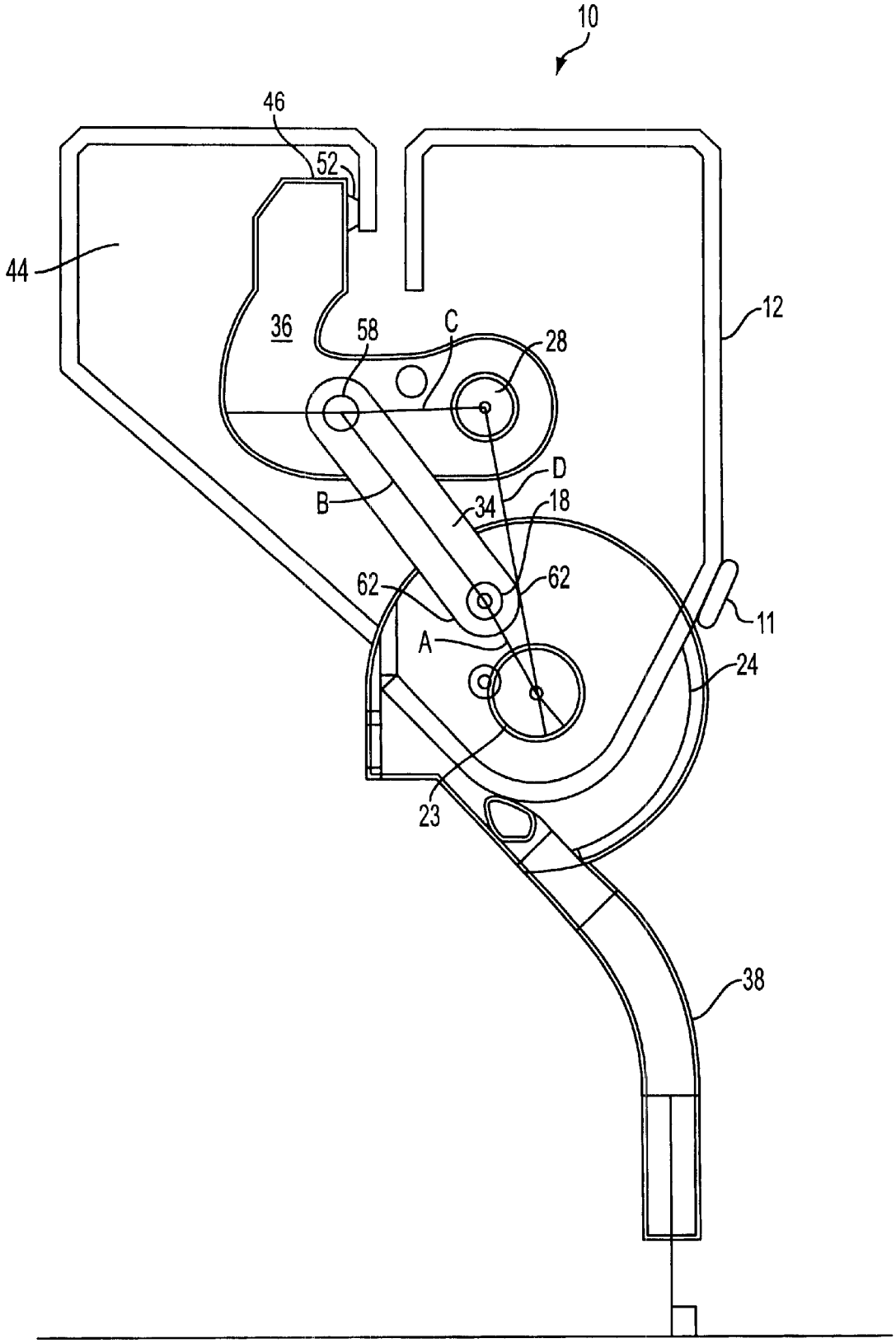
FIG. 2 is a side view of the engaged door latch showing the catch in an engaged, fully raised position.
Figure 3:
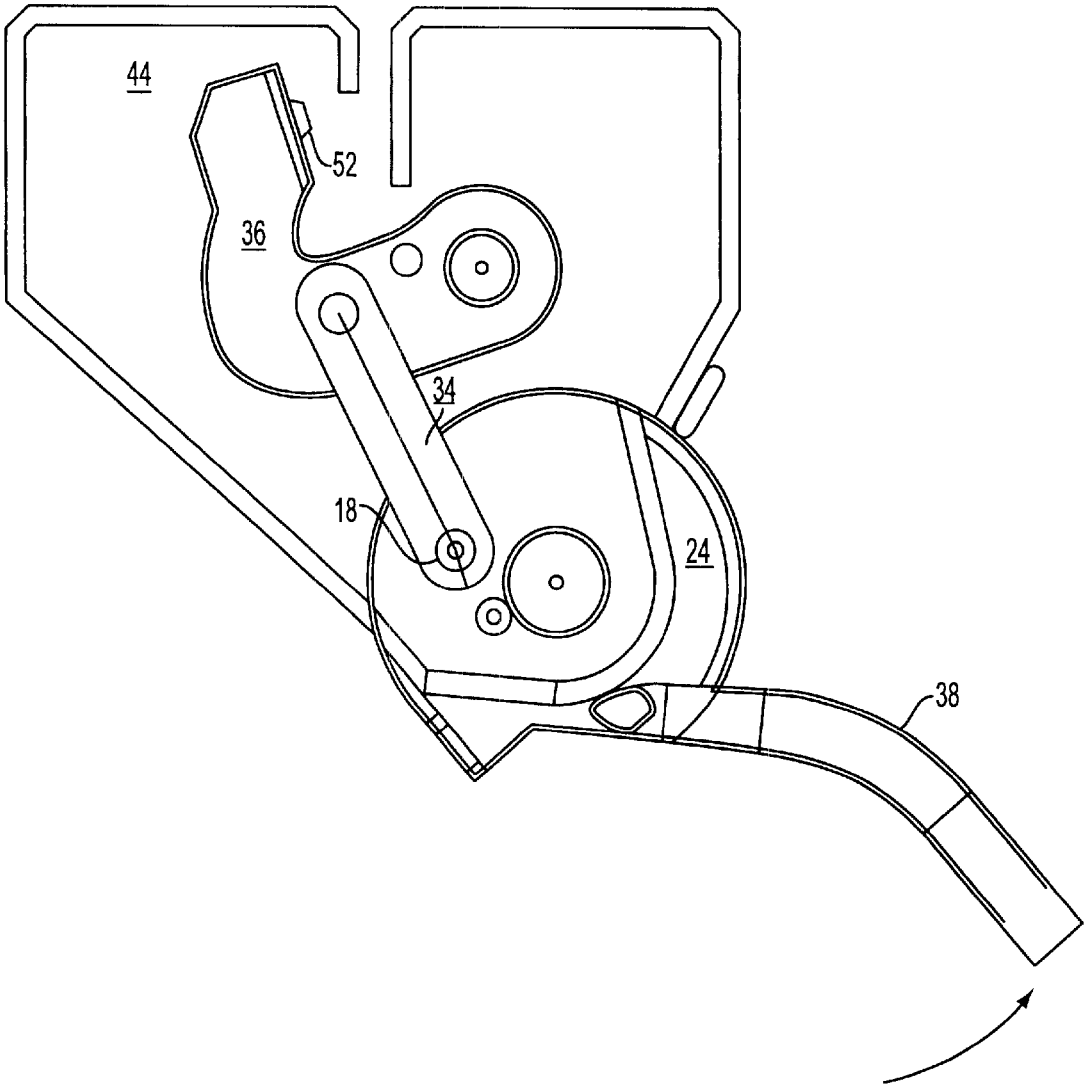
FIG. 3 is a side view of the door latch showing the latch assembly moving from the engaged position to a disengaged position.
Figure 4:
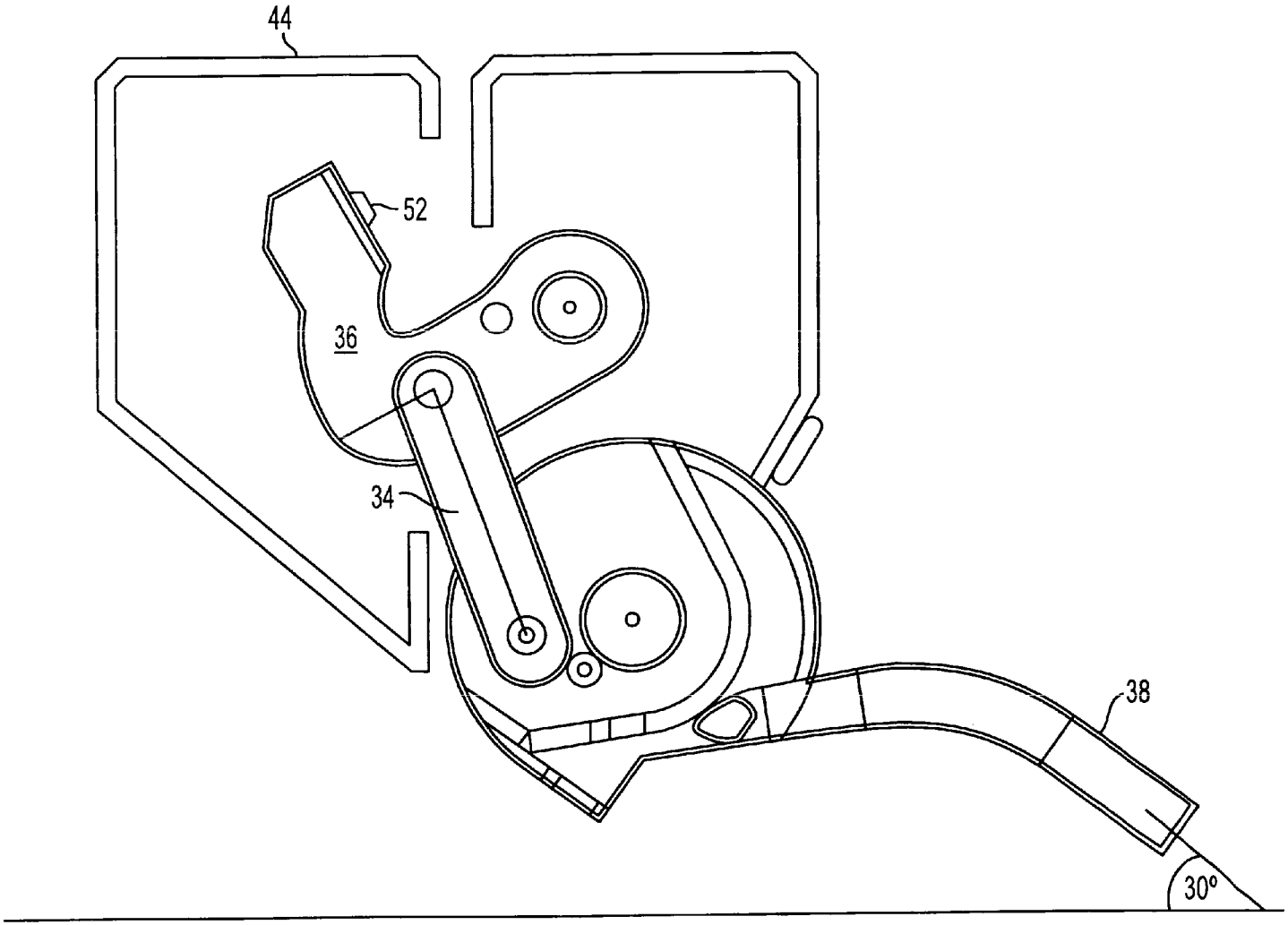
FIG. 4 is a side view of the door latch showing the catch in a disengaged, fully lowered position.

Referring to FIGS. 2–4, it will be seen that just prior to closing and latching the door, the latch will be in the position shown in FIG. 4. As the user pushes the door shut, the user simultaneously pushes on the end of the handle and the latch transitions into the intermediate position shown in FIG. 3. The user continues to push on the door handle until the latch assumes the position fully latched shown in FIG. 2. In the operation, the latch assembly 10 is engaged due to a force exerted upon the handle 38, the intermediate link 34 is operable to displace the catch 36, rotating the catch 36 about the center pin 28 to the fully raised position and inserting the catch 36 into the strike 44.

In the fully latched position, the catch 36 has the adjustment screw 52 abutting against the inside of the strike 44. It is possible to rotate the adjustment screw 52 to move the head of the screw inward or outward relative to the catch. This will adjust the relative contact location of the catch. In effect, this adjustment adjusts the final latching position. In the final latching position, the compressive force secures the latch in the closed position due to a reversal of the internal force of inter link 34 acting on drive link 24 after pin 18 rotates through the "deadpoint" that occurs when pins 20, 18 & 58 are co-linear. The adjustment screw 52 provides essentially two results from the adjustment. First, the adjustment screw provides the ability to accommodate for tolerances and misalignments between the door and the frame. Second, for a given installation, the adjustment of the adjustment screw will affect the amount of the compressive latching force that is distributed through the latch assembly 10.

Rotation of the adjustment screw 52 may be effected in any expedient matter. For example, the screw may be threaded into a throughbore that passes completely through the catch 36 so that the head of the screw is exposed at one end, and the opposite end of the screw is exposed via the bore or a no-head set screw is used. The opposite end of the adjustment screw may have a slot or a Phillips head slot, or a hex slot, or any suitable surface that can be rotated by insertion of a tool into that end of the bore to rotate the screw. Alternatively, the user can simply access the head of the adjustment screw 52 and rotate it directly. This adjustment can of course be performed when the door is opened or closed.

If the screw is able to be rotated from the end opposite the head, it is possible in some embodiments to effect the adjustment when the door is latched by removing the cover plate 12 and positioning the screwdriver through the slot 59 to reach the end of the screw 52 opposite the head via the bore 42.

To open the door, the user pulls on the handle 38 in the position of FIG. 2, to transition the handle through the position shown in FIGS. 3 and 4 respectively. Exerting a force upon the handle 38 opposite that which is required to engage the latch assembly 10 will cause the intermediate link 34 to displace the catch 36, rotating the catch 36 to the fully lowered position and extracting the catch 36 from the receptacle end 45 causing the latch assembly 10 to disengage.

It can be seen that opening and unlatching the door can be accomplished with a single one-handed motion if desired. Also, closing and latching the door can be accomplished with a single one-handed motion.

The range of rotation of the catch 36 about the center pin 28 is limited at the fully raised position (shown in FIG. 1 and FIG. 2) by contact between the drive link 24 and mounting bolt 80 and/or intermediate link 34 and drive link 24. The range of rotation at the fully lowered position (shown in FIG. 4) is limited by contact between the drive link 24 and stop 84 and/or the drive link 24 with intermediate link 34. When the latch assembly 10 is engaged and the catch 36 is in the fully raised position, the handle 38 is positioned at a 90 degree angle to horizontal as shown in FIG. 2. Conversely, FIG. 4 illustrates the handle 38 pivoted 60 degrees from the position of the handle 38 shown in FIG. 2., where the latch assembly 10 is disengaged and the catch 36 is in the fully lowered position so that the handle 38 is positioned at a 30 degree angle to horizontal.

FIG. 2 illustrates the latch assembly engaged including the center intermediate link 34 and the center link pin 18. The center intermediate link 34 is pivotally coupled at one end to the driving link 24. The handle is positioned at a 90 degree angle causing the center link pin 18 to pass through the deadpoint. Consequently, internal forces acting on the drive link 24 reverse direction to secure assembly 10 latched into the locked position. As a result, the catch 36 is in the fully raised position and inserted into the receptacle 45 of the strike 44 and the door seal clamping force prevents unassisted opening. The catch 36 is shown in contact with the strike 44 and the adjustment-screw housing 42 is aligned with slot the 59. Slot 59 allows tool clearance to adjust screw 52 in latched position. In addition, because the over-center linkage is in the locked position, rightward pressure on the handle 38 is required to disengage the door latch assembly 10, thereby reducing the chances of accidental disengagement of the catch 36. The amount of closing travel is limited by contact between driving link 24 and displacement stop 84 or driving link 24 and center link 34. As depicted in FIG. 2, the latch assembly generally operates according to a four-bar linkage characteristic. A first bar linkage (A) is shown extending between the pivot pin 20 and the center link pin 18. A second bar linkage (B) extends along the shaft of the center intermediate link 34 between the center link pin 18 and the center pin 58. A third bar linkage (C) extends between the center link pin 58 and the center pin 28. A fourth bar linkage (D) which forms a base of the four bar linkage extends between the center pin 28 and the pivot pin 20.

The catch 36 is released by pulling upward on the handle 38 which causes the driving link 24 to rotate counter clockwise and in turn pulls downward on the pivot linkage of the center intermediate link 34. FIG. 3 shows the door latch assembly moving from an engaged to disengaged position. The handle 38 is rotating counter clockwise from its 90 degree position illustrated in FIG. 2 along the 60 degree swing angle. Due to the movement displayed, the driving link 24 rotates displacing the center link pin 18 through the deadpoint. At that moment internal forces acting on drive link 24 reverse direction allowing assembly 10 to open freely. Continued counter clockwise rotation of drive link 24 displaces the center link and rotates catch 36 about the center pin 28, disengaging the catch 36 from the strike 44.

FIG. 4 shows the door latch assembly 10 disengaged. The handle 38 is positioned at a 30 degree angle to horizontal and the center linkage is located below the deadpoint and the catch 36 is disengaged. There are no forces acting on latch (except gravity) when the catch is not engaged and compressing the door seal.

The angular dimensions given in this application with respect to the handle are by way of example only. Depending on the dimensions of the various elements of the latch, any of a wide range of angles may be employed so that the catch is able to be engaged and retracted from a striker 44. Also, although a separate strike element is illustrated in a preferred embodiment, it will be appreciated that the strike and latch assembly 10 may be inverted such that the strike is attached to door frame and latch assembly attached to cabinet. One preferred embodiment of the invention is used as a latch for a refrigerator door. However, the latch may be suitable for latching other doors to frames, and may also be employed to latch two panels together.

Due to the post-deadpoint positioning of the assembly when in the latched position, the user is provided with a positive tactile, and in some embodiments audible, indication that the door is securely fastened in the latched position. This provides a significant advantage of the invention by which the user in some embodiments can with a single hand motion push the door closed, latch the door, and receive a feedback that the door is latched. Moreover, the deadpoint latching feature tends to retain the latch in the latched position, so that minor unintentional bumping of the handle will not release the handle undesirably. Also due to the latching feature, when it is desired to open the door, the user is provided with similar indication of overcoming the deadpoint position, and in some embodiments the user can in one motion unlatch and open the door.

The resistance to unintentional opening, and the positive indication of a latched or unlatched state, provided by the above described latch is a significant advantage of the invention. For example, when the latch is used on a door of a refrigerator for medical or experimental samples, it can be very important that these samples be retained within the closed refrigerator for an extended period of time. Therefore, ensuring that the door is closed and that it does not accidentally open can be very beneficial. Some embodiments of the invention provide this by virtue of the positive latching feature.

Figure 5:
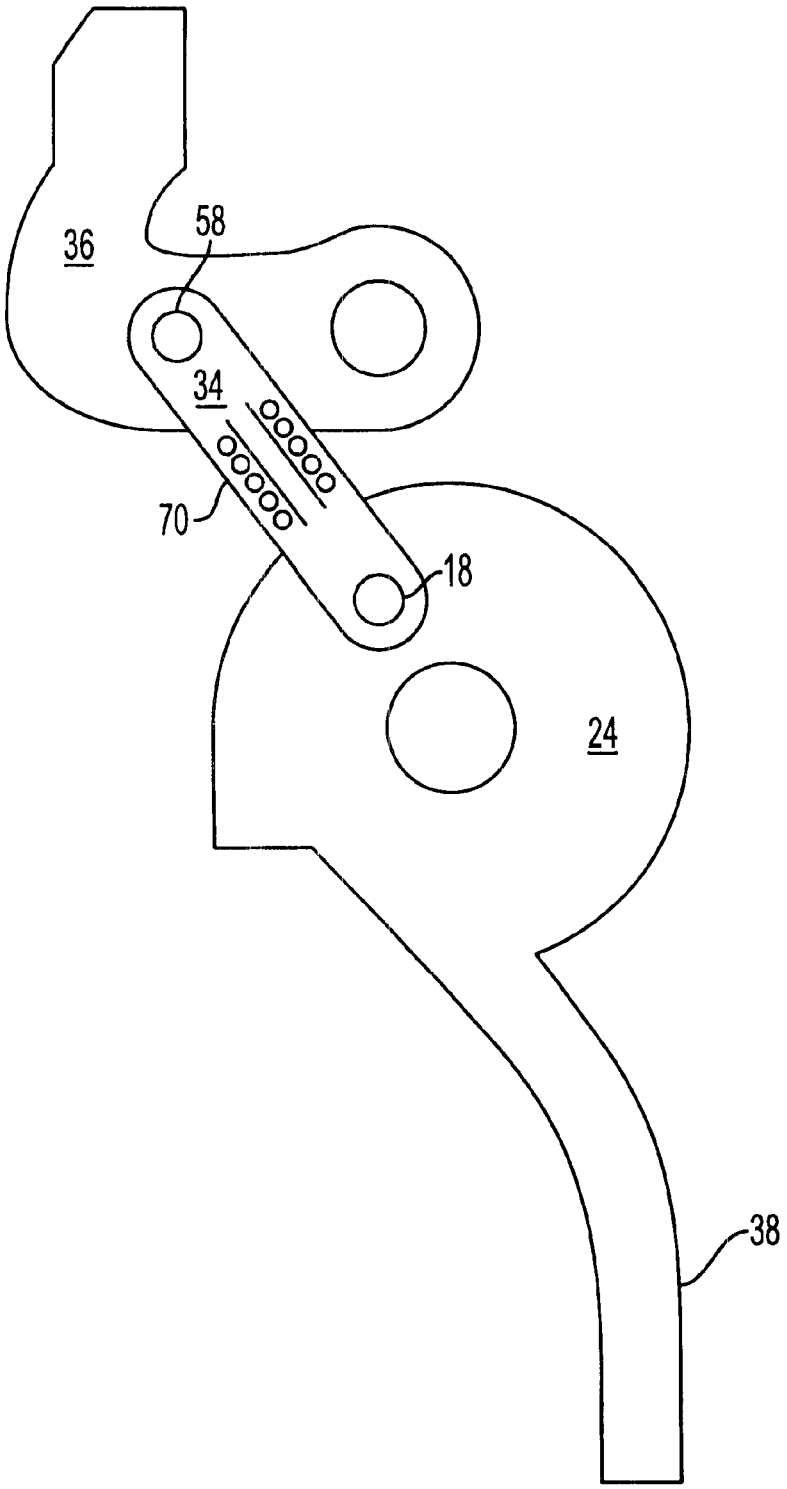
FIG. 5 is partial side view of an alternative embodiment of the latch assembly.

In an alternative embodiment shown in FIG. 5, a compliance member 70 is provided to permit some lateral compliance between the driving link 24 and the contact part of catch 36 with the strike 44. The compliance member 70 may be a spring, elastomer or any other resilient component. As illustrated in FIG. 5, the center intermediate link 34 may include a compliance member 70 permitting expansive or contractive movement relative to the driving link 24 due to the addition of the compliance member 70. The aforementioned adaptation will absorb some or all of the compressive and expansive forces created when the catch 36 is inserted into the strike 44, which without a compliance member 70 may cause the door latch assembly 10 to fail when engaged. This allows the catch to engage the strike when the gasket is obstructed by foreign bodies which otherwise would reduce the reach of the catch 36 and therefore hinder engagement of the catch 36. In addition, the compliance mechanism may prevent overload of the latch due to expansive forces due to ice build-up on the gasket.

Figure 6:
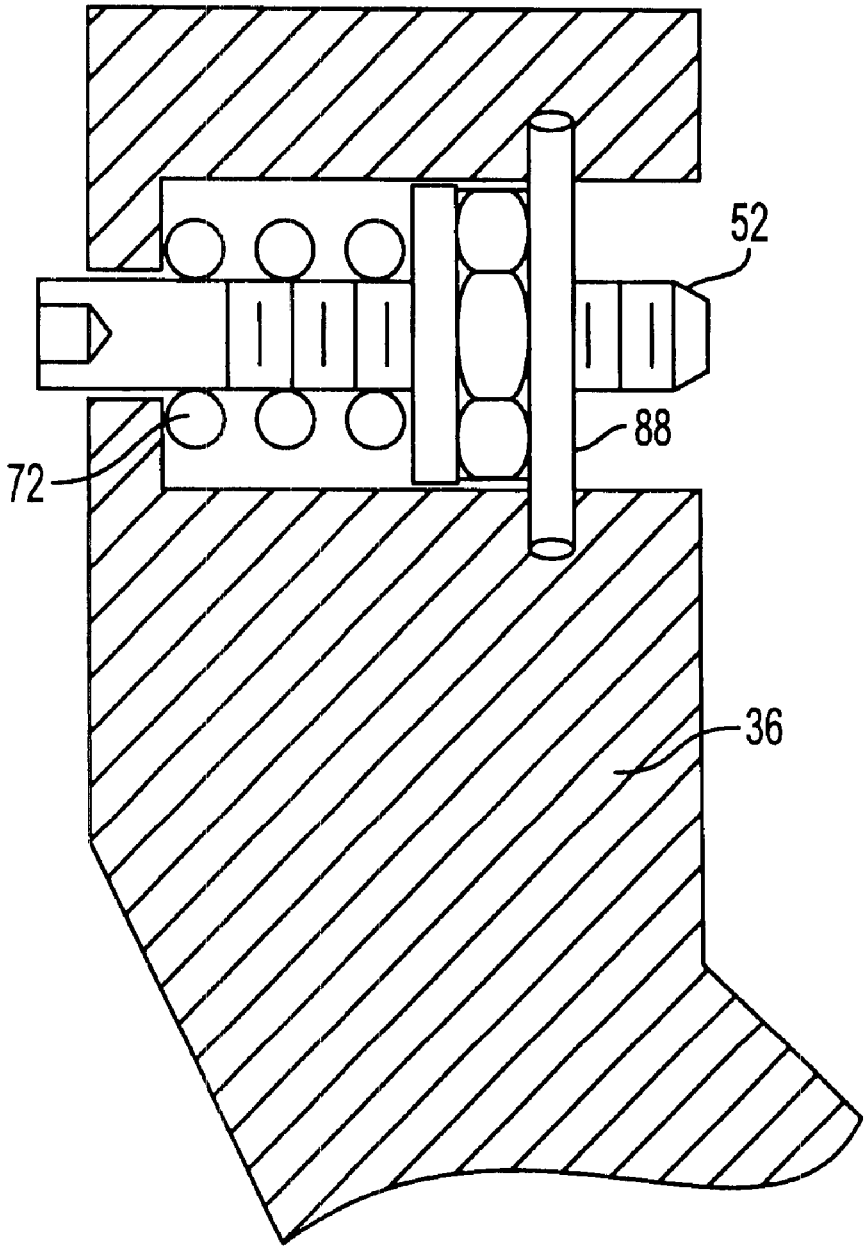
FIG. 6 is a partial side view showing an alternative embodiment of the catch and an adjustment screw.

FIG. 6 illustrates an exploded sectional view of the catch 36 and adjustment screw housing 42 with the adjustment screw 52 inserted, and shows an alternative embodiment in which the micro-screw housing 42 has been fitted with a compliance member 72 permitting some axial travel of the adjustment screw 52 relative to the catch 36. In the preferred embodiment, the compliance member 72 is a helical spring preloaded to the latching force, held by a retaining clip 88. This compliance member 72 also may be a spring, elastomer or any other resilient member. The compliance member 72 will absorb some or all of the excessive compressive forces created when the catch 36 is inserted in the strike 44. Rotation of the adjustment screw 52 in the housing 42 will modify these internal forces when the catch 36 is in the fully raised position.

Figure 7:
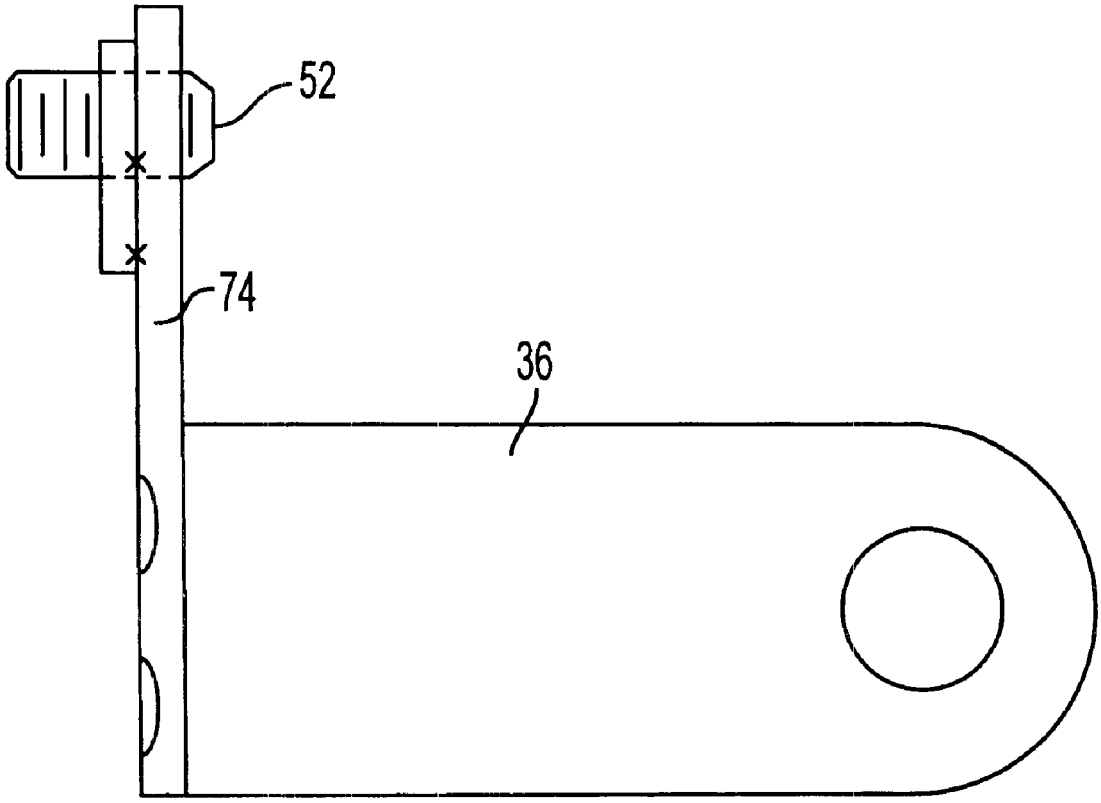
FIG. 7 is a partial side view of an alternative embodiment of the catch.

FIG. 7 illustrates an alternative embodiment of the catch 36 in which the sectional portion of the catch which engages the strike 44 itself has a compliance member such as a leaf spring 74. The leaf spring 74 permits some lateral travel within the catch 36 relative to the micro screw 52. The leaf spring 74 will absorb some or all of the compressive forces created when the catch 36 is inserted into the strike 44 and the catch is locked. In addition the leaf spring 74 can extend the reach of the catch 36. This allows the catch to engage the strike 44 when the gasket is obstructed by foreign bodies which would otherwise reduce the reach of the catch 36 and therefore hinder engagement of the catch 36.

Figure 8:
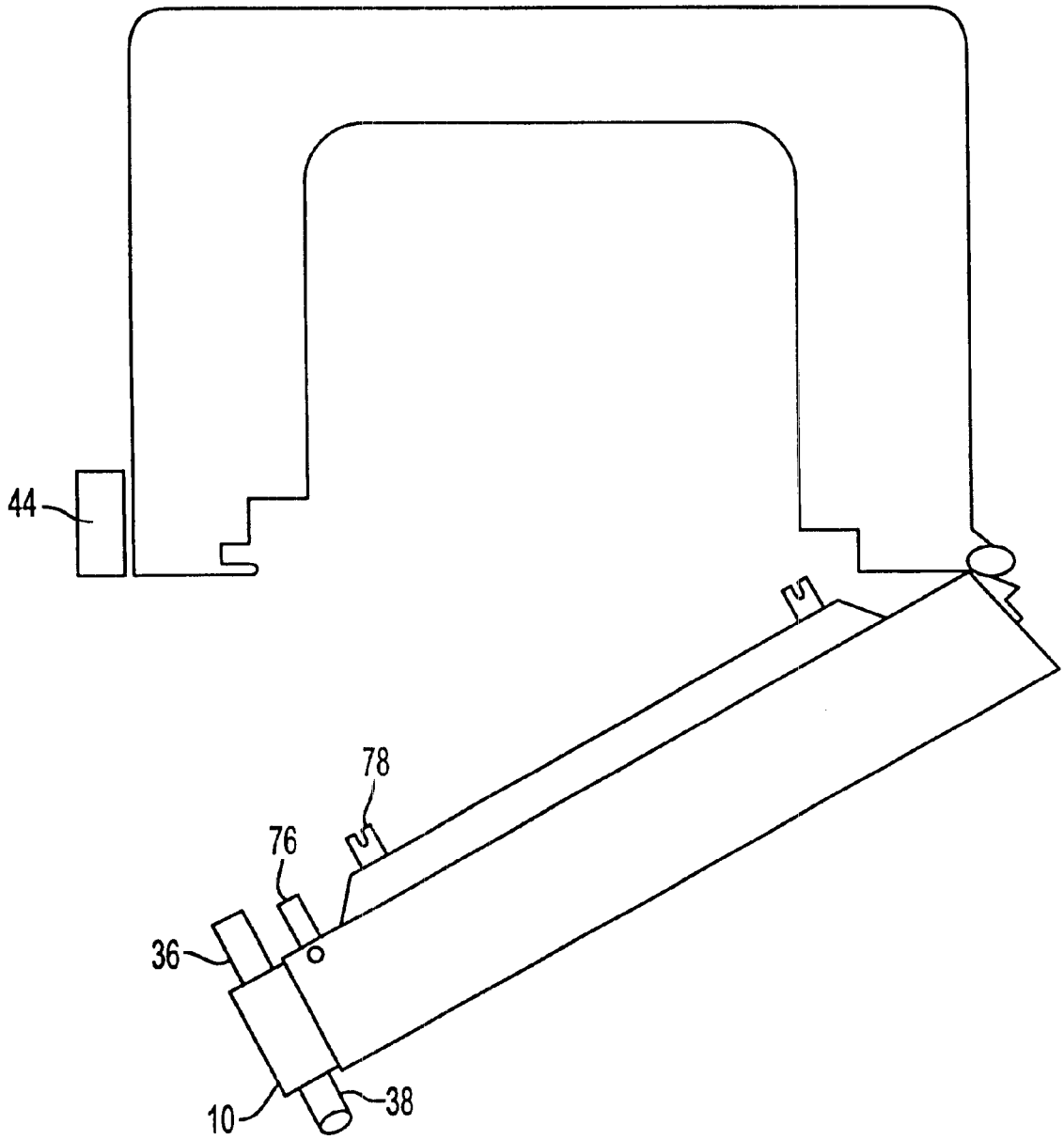
FIG. 8 is a top view showing a latch installed on a refrigerator door.

FIG. 8 is a sectional elevation view of the latch assembly attached to a refrigerator door 76, illustrating an example of a door resistance beginning at 2 inches. In this example, the latch of the invention effectively engages at 1.25 inches while prior latches engage at 1 inch. Once engaged, the latch assembly maintains a 0.625 inch compression of the gasket 78. These dimensions are by way of example only.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A latch assembly adapted for mounting on a door panel and securing said door panel to a frame, the latch assembly comprising:

a base adapted to be mounted to the door panel;

a catch pivotally mounted to said base for rotation about a first axis and having a contact portion;

a strike adapted for mounted to said frame so that said strike can receive said catch;

a handle pivotally mounted to said housing for rotation about a second axis;

a link pivotally mounted to said catch at a first point and to said handle at a second point, said handle moveable between a first position where said contact portion of said catch is urged into contact against said strike via said link and a second position where said catch is retracted from said strike via said link;

first oblong holes on said strike that provide horizontal adjustment of said strike; and second oblong holes on said base that provide vertical adjustment of said base, and wherein said panel and frame are of sheet metal construction and said base has a surface area that distributes load from said base to said sheet metal.

2. A latch assembly according to claim 1, wherein said link comprises a link member and said latch assembly forms a four bar linkage.

3. A latch assembly according to claim 2, further comprising a resilient compliance element that absorbs forces between said contact portion of said catch and said handle assembly.

4. A latch assembly according to claim 1, further comprising an adjusting device on said catch that adjusts said contact portion of said catch.

5. A latch assembly according to claim 1, wherein said adjustment device is a rotatable, threaded member mounted on said catch that adjusts said contact portion of said catch.

6. A latch assembly according to claim 5, further comprising a compliance element that absorbs forces between said adjusting device and said catch.

7. An adjustment device according to claim 5, wherein said adjustment device comprises a rotatable, threaded member mounted on said catch.

8. A latch assembly according to claim 1, further comprising a lock for locking said handle into said first position.

9. A latch assembly according to claim 1, further comprising a first aperture on said base and a second aperture on a driving link for insertion of a padlock to lock said handle in said first position.

10. A latch assembly adapted for mounting on a door panel and securing said panel to a frame, said latch assembly comprising:

a base adapted to be mounted to said door panel;

a catch pivotally mounted to said base for rotation about a first axis and having a contact portion;

a strike adapted for mounting to said frame so that said strike can receive said catch;

a handle pivotally mounted to said base for rotation about a second axis, said handle moveable between a first position where said contact portion of said catch is urged into contact against said strike and a second position where said catch is retracted from said strike;

an adjusting device on said catch that adjusts said contact portion to said catch;

first oblong holes on said strike that provide horizontal adjustment of said strike; and second oblong holes on said base that provide vertical adjustment of said base, and wherein said panel and frame are of sheet metal construction and said base has a surface area that distributes load from said base to said sheet metal.

11. A latch assembly according to claim 10, wherein said adjustment device comprises a rotatable, threaded member mounted on said catch that adjusts said contact portion of said catch.

12. A latch assembly adapted for mounting a panel and securing said panel to a frame, said assembly comprising:

a base adapted to be mounted to said panel;

a catch pivotally mounted to said housing for rotation about a first axis;

a strike adapted for mounting to said frame so that said strike can received said catch;

a handle assembly pivotally mounted to said housing for rotation about a second axis, said handle assembly moveable between a first position where a portion of said catch is urged into contact against said strike with a contact force, and a second position where said catch is retracted from said strike;

first oblong holes on said strike that provide horizontal adjustment of said strike;

second oblong holes on said base that provide vertical adjustment of said base, and wherein said panel and frame are of sheet metal construction and said base has a surface area that distributes load from said base to said sheet metal; and a compliance mechanism that absorbs at least port of the contact force.

13. A latch assembly according to claim 12, where said compliance mechanism absorbs over compression forces which peak at a dead point and overload forces when said door seal is unusually stiffened by ice or other foreign material.

14. A latch assembly according to claim 12, wherein said compliance element comprises a resilient link between said handle assembly and said catch.

15. A latch assembly according to claim 12, wherein said compliance element comprises an elastomeric portion of said catch.

16. A latch assembly according to claim 12, wherein said compliance element is a leaf spring.

17. A method for latching a door to a frame using a catch received in a strike, comprising the steps of adjusting a contact point of the catch with the strike;

horizontally adjusting the strike via first oblong holes;

vertically adjusting via second oblong holes, a base adapted to be mounted on said door; and urging the catch against the strike by moving a handle.

18. A method according to claim 17, wherein the adjusting step includes rotating a threaded contact member that is threaded into bore of the catch.

19. A method of latching a door to a frame using a catch received in a strike, comprising the steps of:

urging the catch against the strike by using a handle;

horizontally adjusting the strike via first oblong holes;

vertically adjusting via second oblong holes, a base adapted to be mounted on said door; and absorbing at least part of a contact force between the catch and the strike with a compliance element when the handle is urging the catch against the strike.

20. A method according to claim 19, wherein the absorbing step is performed by a resilient link between the handle assembly and the catch.

21. A method according to claim 19, wherein the absorbing step is performed by an elastomeric portion of the catch.

22. A latch assembly for latching a door to a frame comprising:

a strike;

a catch adapted to be received in said strike;

means for adjusting a contact point of said catch with said strike;

means for urging the catch against the strike by moving a handle;

means for horizontal adjustment of said strike; and means for vertical adjustment of a base adapted to be mounted on said door.

23. A latch assembly according to claim 22, wherein said adjusting means includes a threaded contact member that is threaded into a bore of said catch.

24. A latch assembly for latching a door to a frame comprising:

a strike;

a catch adapted to be received in said strike;

means for urging the catch against the strike by using a handle;

means for absorbing at least part of a contact force between said catch and said strike when the handle is urging the catch against the strike;

means for horizontal adjustment of said strike; and means for vertical adjustment of a base adapted to be mounted on said door.

25. A latch assembly according to claim 24, wherein the absorbing means comprises a resilient link between the handle assembly and the catch.

26. A latch assembly according to claim 24, wherein the absorbing means comprises an elastomeric portion of the catch.

* * * * *